US006011522A

United States Patent [19]

VanHoozen et al.

[11] Patent Number: 6,011,522

[45] Date of Patent: Jan. 4, 2000

[54] CONFORMAL LOG-PERIODIC ANTENNA ASSEMBLY

[75] Inventors: Allen Lee VanHoozen, Schaumburg; John Ball, McHenry, both of Ill.

[73] Assignee: Northrop Grumman Corporation, Los Angeles, Calif.

[21] Appl. No.: 09/044,201

[22] Filed: Mar. 17, 1998

[51] Int. Cl.[7] ..... H01Q 11/10

[52] U.S. Cl. ..... 343/792.5; 343/859

[58] Field of Search ..... 343/792.5, 700 MS, 343/859, 789, 837, 756

[56] References Cited

U.S. PATENT DOCUMENTS

| | | | |
|---|---|---|---|
| Re. 29,911 | 2/1979 | Munson | 343/700 |
| 3,534,372 | 10/1970 | Scheuerecker et al. | 343/742 |
| 3,683,390 | 8/1972 | Cory et al. | 343/792.5 |
| 3,696,437 | 10/1972 | Grant | 343/792.5 |
| 3,990,079 | 11/1976 | Epis | 343/771 |
| 4,063,249 | 12/1977 | Bergander et al. | 343/756 |
| 4,117,489 | 9/1978 | Kaloi | 343/700 |
| 4,163,236 | 7/1979 | Kaloi | 343/700 |
| 4,170,012 | 10/1979 | Kaloe | 343/700 |
| 4,243,993 | 1/1981 | Lamberty et al. | 343/895 |
| 4,326,203 | 4/1982 | Kaloi et al. | 343/700 |
| 4,364,050 | 12/1982 | Lopez | 343/700 |
| 4,401,988 | 8/1983 | Kaloi | 343/700 |
| 4,445,122 | 4/1984 | Pues | 343/700 |
| 4,450,449 | 5/1984 | Jewitt | 343/700 |
| 4,594,595 | 6/1986 | Struckman | 343/770 |
| 4,608,572 | 8/1986 | Blakney et al. | 343/792 |
| 4,761,654 | 8/1988 | Zaghloul | 343/700 |
| 4,835,538 | 5/1989 | McKenna et al. | 343/700 |
| 4,849,765 | 7/1989 | Marko | 343/702 |
| 4,864,314 | 9/1989 | Bond | 343/700 |
| 4,907,011 | 3/1990 | Kuo | 343/792.5 |
| 4,943,809 | 7/1990 | Zaghloul | 343/700 |
| 5,005,019 | 4/1991 | Zaghloul et al. | 343/700 |
| 5,008,681 | 4/1991 | Cavallaro et al. | 343/700 |
| 5,021,796 | 6/1991 | Corzine et al. | 343/712 |
| 5,111,211 | 5/1992 | Dahlberg | 343/700 |
| 5,124,713 | 6/1992 | Mayes et al. | 343/700 |
| 5,164,738 | 11/1992 | Walter et al. | 343/789 |
| 5,187,490 | 2/1993 | Ohta et al. | 343/700 |
| 5,191,351 | 3/1993 | Hofer et al. | 343/895 |
| 5,210,541 | 5/1993 | Hall et al. | 343/700 |
| 5,212,494 | 5/1993 | Hofer et al. | 343/859 |
| 5,220,335 | 6/1993 | Huang | 343/700 |
| 5,231,406 | 7/1993 | Sreenivas | 343/700 |

(List continued on next page.)

*Primary Examiner*—Don Wong
*Assistant Examiner*—James Clinger
*Attorney, Agent, or Firm*—Terry J. Anderson; Karl J. Hoch, Jr.

[57] ABSTRACT

A conformal log-periodic antenna assembly having a broadband frequency response as a printed circuit board having a plurality of log-periodic antennas etched thereupon. Each log-periodic antenna has a plurality of antenna elements extending from a common trunk. The trunk of each log-periodic antenna extends generally radially from a common point. A foam spacer is disposed at the backside of the printed wiring board. A dielectric layer is disposed at the backside of the foam spacer. An absorber layer is disposed at the backside of the dielectric layer. A metal backing is disposed at the backside of the absorber layer for reflecting lower frequency electromagnetic radiation back to the antenna so as to enhance an intensity thereof. The dielectric layer enhances response across a broad frequency band and the foam spacer positions the antennas a desired distance from the metal backing such that reflections therefrom enhance operation of the antennas.

29 Claims, 3 Drawing Sheets

U.S. PATENT DOCUMENTS

| | | | |
|---|---|---|---|
| 5,309,163 | 5/1994 | Ngan et al. | 343/700 |
| 5,313,216 | 5/1994 | Wang et al. | 343/700 |
| 5,315,753 | 5/1994 | Jensen et al. | 29/600 |
| 5,376,942 | 12/1994 | Shiga | 343/700 |
| 5,382,959 | 1/1995 | Pett et al. | 343/700 |
| 5,400,040 | 3/1995 | Lane et al. | 343/700 |
| 5,400,041 | 3/1995 | Strickland | 343/700 |
| 5,410,323 | 4/1995 | Kuroda | 343/700 |
| 5,448,250 | 9/1995 | Day | 343/700 |
| 5,448,252 | 9/1995 | Ali et al. | 343/700 |
| 5,453,751 | 9/1995 | Tsukamoto et al. | 343/111 |
| 5,471,220 | 11/1995 | Hammers et al. | 342/372 |
| 5,471,664 | 11/1995 | Kim | 455/323 |
| 5,477,231 | 12/1995 | Medard | 343/700 |
| 5,483,678 | 1/1996 | Abe | 455/80 |
| 5,497,164 | 3/1996 | Croq | 343/700 |
| 5,506,592 | 4/1996 | MacDonald et al. | 343/846 |
| 5,510,803 | 4/1996 | Ishizaka et al. | 343/700 |
| 5,565,875 | 10/1996 | Buralli et al. | 343/700 |
| 5,572,222 | 11/1996 | Mailandt et al. | 343/700 |
| 5,576,718 | 11/1996 | Buralli et al. | 343/700 |
| 5,594,455 | 1/1997 | Hori et al. | 343/700 |
| 5,648,786 | 7/1997 | Chung et al. | 343/770 |
| 5,657,028 | 8/1997 | Sanad | 343/700 |
| 5,680,144 | 10/1997 | Sanad | 343/700 |
| 5,703,601 | 12/1997 | Nalbandian et al. | 343/700 |

CONFORMAL LOG-PERIODIC ANTENNA ASSEMBLY

FIELD OF THE INVENTION

The present invention relates generally to broadband antennas and more particularly to a conformal log-periodic antenna assembly having a broadband frequency response suitable for use in unmanned air vehicles and the like.

BACKGROUND OF THE INVENTION

Broadband antennas for receiving a broadband of radio-frequency signals are well known. Such broadband antennas generally comprise a plurality of antenna elements of different lengths electrically connected to one another such that at least one of the antenna elements is suitable for receiving and/or transmitting at a desired frequency.

It is also known to form such an array of antenna elements in a flat, generally circular configuration so as to define a broadband antenna which requires minimal volume. One example of such a circular broadband antenna is disclosed in U.S. Pat. No. 4,594,595 issued on Jun. 10, 1986 to Struckman and entitled CIRCULAR LOG-PERIODIC DIRECTION-FINDER ARRAY.

Log periodic antennas are also well known. In a log periodic antenna the elements of the antenna increase in length at a logarithmic rate and alternate such that every other element is on an opposite side of a common conductor or trunk. The benefit of such a log periodic configuration is that a substantially greater band width is achieved.

Examples of such circular log periodic antennas are provided in U.S. Pat. No. 4,063,249, issued on Dec. 13, 1997 to Bergander et al., and entitled SMALL BROADBAND ANTENNA HAVING POLARIZATION SENSITIVE REFLECTOR SYSTEM; U.S. Pat. No. 5,164,738, issued on Nov. 17, 1992 to Walter et al., and entitled WIDE BAND DUAL-POLARIZED MULTIMODE ANTENNA; and U.S. Pat. No. 5,212,494 issued on May 18, 1993 to Hoffer et al., and entitled COMPACT MULTI-POLARIZED BROADBAND ANTENNA.

It is worthy to note that various different linear polarizations, as well as the ability to receive and transmit circularly polarized signals, are achieved in Hoffer et al., and Walter et al., by forming the circular antenna assembly to comprise two orthogonal log-periodic antennas. By way of contrast, Bergander utilizes two separate orthogonal antenna assemblies to achieve the same result.

Although log-periodic antennas have proven generally suitable for their intended uses, such conventional antennas are generally too thick to be utilized in applications wherein it is desirable that the antenna be disposed as flush as possible to the surface upon which the antenna is mounted. Such flush mounting of an antenna is particularly desirable in aircraft applications, wherein it is desirable to minimize aerodynamic drag by streamlining the fuselage, wings, and any other aerodynamic surfaces thereof. It is particularly important to minimize drag in aircraft which fly at high speeds, as well as those which must fly for considerable distances without refueling. For example, the Unmanned Air Vehicle (UAV) is an unmanned military surveillance aircraft which must fly a considerable distance without refueling. Thus, it is desirable to minimize drag upon the aircraft, so as to increase the effective range thereof.

It is also desirable to provide an antenna which is conformal, i.e., which conforms generally to the curvature or shape of the surface upon which it is mounted. The use of such a conformal antenna further minimizes undesirable aerodynamic drag by tending to maintain the general shape of the surface upon which it is mounted. The use of such a conformal antenna also minimizes distortion or modification of such a surface. That is, the surface does not require modification in order to accommodate the antenna.

Thus, as those skilled in the art will appreciate, it is desirable to provide a broadband log-periodic antenna assembly which is comparatively thin and therefore does not extend substantially above the surface upon which is it mounted and which may be formed so as to be generally conformal to that surface.

SUMMARY OF THE INVENTION

The present invention specifically addresses and alleviates the above mentioned deficiencies associated with the prior art. More particularly, the present invention comprises a conformal log-periodic antenna assembly having a broadband frequency response. The antenna assembly comprises a printed wiring board having front and back sides and a plurality of individual log-periodic antennas etched upon at least one side of the printed wiring board.

Each log-periodic antenna comprises a plurality of separate antenna elements extending from a common trunk. The trunk of each log-periodic antenna extends generally radially from a common point.

A foam spacer having front and back sides is disposed at the back side of the printed wiring board. A dielectric layer having front and back sides is disposed at the back side of the foam spacer. An absorber layer having front and back sides is disposed at the back side of the dielectric layer. A metal backing is disposed at the back side of the absorber layer. The metal backing reflects lower frequency electromagnetic radiation back to the antenna so as to enhance the intensity thereof. The foam spacer positions the antennae a desired distance from the metal backing so as to facilitate such constructive interference. The dielectric layer enhances the response of each antenna across a broad frequency band, thereby broadening the frequency response of the antenna assembly.

Each antenna element preferably comprises portions of generally concentric circles. Thus, the antenna assembly comprises a plurality of segments of generally concentric circles.

According to the preferred embodiment of the present invention, each antenna comprises two diametrically opposed trunks, each trunk having elements of substantially identical lengths extending generally perpendicularly therefrom in generally opposite directions.

The plurality of log-periodic antennas preferably comprise two log-periodic antennas disposed generally orthogonal to one another, so as to facilitate the reception and transmission of a plurality of polarizations of plane polarized electromagnetic radiation as well as circularly polarized electromagnetic radiation. Those skilled in the art will appreciate that plane polarized and circularly polarized (either right or left hand) electromagnetic radiation can be received or transmitted via two antennas which are oriented perpendicular with respect to one another.

According to the preferred embodiment of the present invention, the plurality of log-periodic antennas comprise two log-periodic antennas disposed generally orthogonal to one another, each of the two antennas comprising two diametrically opposed trunks.

A resistive film is formed at a distal end of at least one preferably both, of the elements of at least one, preferably both, of the antennas, so as to enhance the response of those elements. As those skilled in the art will appreciate, the application of such as resistive film increases the apparent length of the element, and thus enhances the response of the element to lower frequencies. In this manner, a substantially more compact and volume efficient broadband antenna is formed.

According to the preferred embodiment of the present invention, the antennas are etched upon the front side of the printed wiring board. However, as those skilled in the art will appreciate, the antennas may be formed on the front side, rear side, and/or upon an intermediate layer of the printed wiring board, as desired.

Further, according to the present invention, the antenna elements of adjacent antennas are not interleaved. However, according to an alternative embodiment of the present invention, the antenna elements may be interleaved, so as to further broaden the frequency response of the antenna.

The foam spacer is sufficiently flexible so as to allow the antenna assembly to substantially conform to a curved metal backing. That is, the flexible foam spacer is sufficiently resilient to accommodate a curved metal backing, such as a panel of a aircraft. Further, the printed wiring board is preferably sufficiently thin, namely, 0.1 inches so as to allow the antenna assembly to substantially conform to such a curved metal backing. As such, the printed wiring board is also sufficiently flexible so as to allow the antenna assembly to substantially conform to a curved metal backing. Thus, the printed wiring board, foam spacer, dielectric layer, and absorber layer are all preferably configured so as to substantially conform to a curved metal backing.

The metal backing may be defined by a pre-existing structure, or may alternatively be formed as an integral part of the antenna assembly of the present invention. More particularly, the metal backing may be defined by a portion of an aircraft, such as an unmanned air vehicle, for which the present invention is particularly well suited.

The dielectric layer preferably comprises epoxy and fiberglass. The absorber comprises an electrically lossy material which absorbs electromagnetic radiation by the induction of current therefrom and by converting the electric currents into thermal energy. According to the preferred embodiment of the present invention, the absorber comprises "MAG RAM" (Magnetic Radar Absorbing Mat'l.), a material commonly used in such applications.

In any instance, the metal backing preferably supports the printed wiring board, as well as other components of the conformal log-periodic antenna of the present invention.

The absorber is preferably approximately 0.167 inch thick, the dielectric is preferably approximately 0.06 inch thick. The foam space is preferably approximately 0.25 inch thick.

The conformal log-periodic antenna assembly of the present invention may be formed into an array for use in various different particular applications. For example, a linear array may be formed along the side of an aircraft, so as to enhance antenna gain according to well known principles.

Because of its small size, wide bandwidth, and ability to conform to the curved shape of a preexisting structure, the conformal log-periodic antenna assembly of the present invention finds particular applications in unmanned air vehicles. As those skilled in the art will appreciate, a broadband antenna is required so as to facilitate the reception and transmission of different types of radio signals, each having widely diverse frequencies. This facilitates the transmission and reception of signals for such purposes as flight control, and the communication of surveillance data, which may require widely diverse frequencies. The use of such a broadband antenna also facilitates the use of spread spectrum technology so as to inhibit undesirable reception of the signal and also so as to inhibit undesirable jamming thereof. A plurality of such conformal log-periodic antenna assemblies may be formed into a generally U-shaped configuration so as to generally surround a substantial portion of the aircraft body, thereby facilitating the reception and transmission of radio signals in different directions.

Thus, the present invention provides a broad band log-periodic antenna assembly which is comparatively thin and therefore does not extend substantially above the surface upon which it is mounted and which may be formed so as to generally conform to that surface so as to facilitate conformal mounting upon curved surfaces.

DETAILED DESCRIPTION OF THE PREFERRED INVENTION

The detailed description set forth below in connection with the appended drawings is intended as description of the presently preferred embodiments of the invention and is not intended to represent the only forms in which the present invention may be constructed or utilized. The description sets forth the functions and the sequence of steps for constructing and operating the invention in connection with the illustrated embodiments. It is to be understood, however, that the same or equivalent functions and sequences may be accomplished by different embodiments that are also intended to be encompassed within the spirit and scope of the invention.

The conformal log-periodic assembly of the present invention is illustrated in FIGS. 1–6 which depict presently preferred embodiments thereof.

Figure 1:
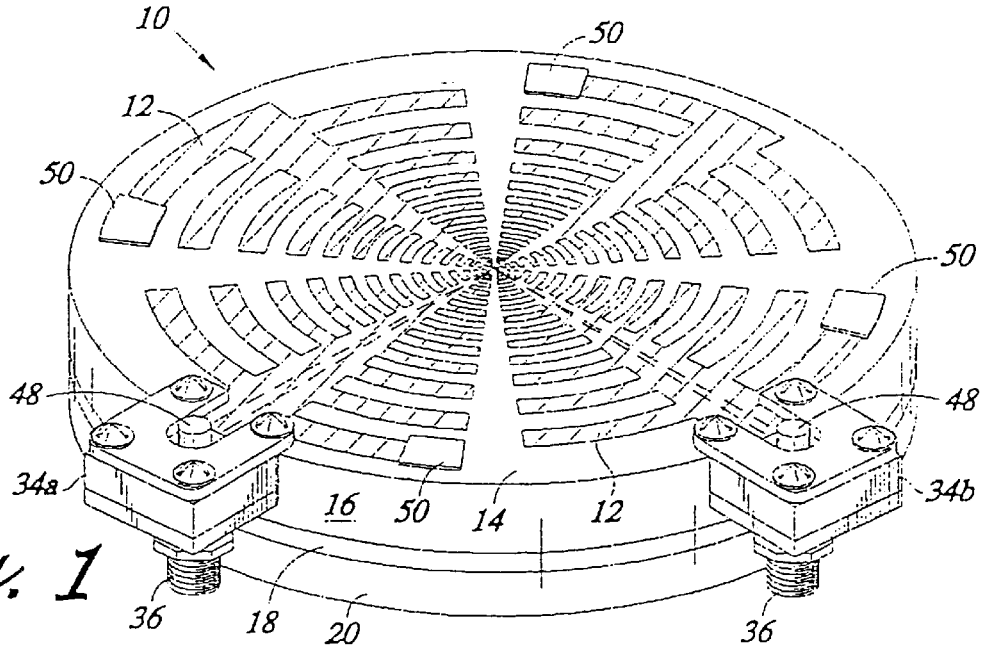
FIG. 1 is a perspective view of the conformal log-periodic antenna assembly of the present invention showing two log-periodic antennas etched upon the front side of the printed wiring board and also showing the foam spacer, dielectric layer, and the absorbing layer thereof.
Figure 2:
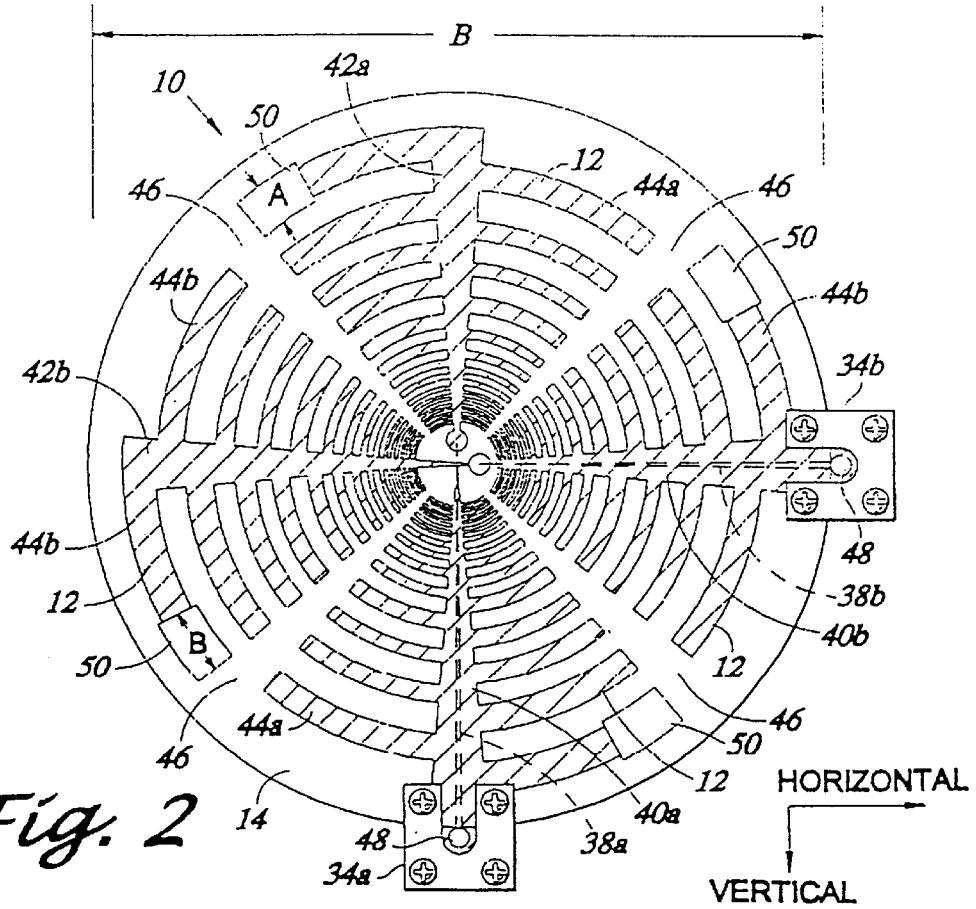
FIG. 2 is a front view of the conformal log-periodic antenna assembly of FIG. 1, better showing the two log-periodic antennas etched upon the printed wiring board.
Figure 3:
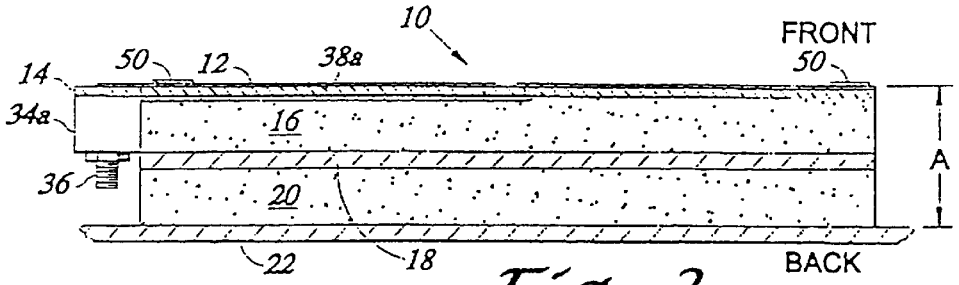
FIG. 3 is a side view showing the conformal log-periodic antenna of FIG. 1 mounted upon a metal backing.

Referring now to FIGS. 1–3, the present invention generally comprises a plurality of etched antennas 12 formed upon an insulating substrate, i.e., printed on the front of a printed wiring board (PWB) 14. The back of the printed wiring board is attached to a foam spacer 16. The back of the foam spacer 16 is attached to a dielectric layer 18. The back of the dielectric layer 18 is attached to an absorber 20. The absorber 20 is either mounted to a metal backing 22 (FIG. 3) or may be mounted a structure, such as an aircraft panel, so as to later define the metal backing.

With particular reference to FIG. 2, the etched antennas 12 preferably comprise a pair of etched antennas defined by first and second trunks 40*a* and 42*a* which are orthogonal to third and fourth trunks 40*b* and 42*b*. The first and second trunks 40*a* and 42*a*, taken along with the antenna elements 44*a* extending generally perpendicularly therefrom define the first log-periodic antenna and the third and fourth trunks 40*b* and 42*b*, taken along with elements 44*b* extending therefrom define the second log-periodic antenna.

The first trunk 40*a* is electrically connected to first connector block 34*a*, preferably such that it is in electrical communication with the shielded conductor of coaxial connector 36, while the micro strip conductor 38*a* is preferably connected so as to be in electrical communication with the center conductor 48 of the conductor block 34*a*.

Similarly, the second trunk 40*b* is electrically connected to the second connector block 34*b*, preferably such that it is in electrical communication with the shielded conductor of the co-axial connector 36, while the microstrip conductor 38*b* is connected so as to be in electrical communication with the center conductor 48 of the conductor block 34*b*.

The micro strip conductor 38*a* attaches to the trunk 42*a* near the center of the antenna, as discussed in detail below. Similarly, the micro strip conductor 38*b* places the center conductor 48 of the second connector block 34*b* in electrical communication with the trunk 42*b* of the second log-periodic antenna via interconnection thereto at the center of the antenna assembly.

Each trunk 40*a*, 40*b*, 42*a*, and 42*b* has a plurality of antenna elements 44 extending generally perpendicularly therefrom so as to define a plurality of generally concentric circle segments which, according to the preferred embodiment of the present invention, do not interleave with one another. Thus, axial spaces 46 are defined between adjacent perpendicular antennas.

It is important to note that one antenna is defined by the two vertical trunks 40*a* and 42*a*, along with the antenna elements 44*a* extending therefrom; while a second, electrically isolated and independent antenna, is defined by the two horizontal trunks 40*b* and 42*b* along with the antenna elements 44*b* extending therefrom. Thus, the conformal log-periodic antenna assembly of the present invention may be utilized to either transmit or receive linearly polarized radio frequency signals at any desired angle, e.g., 15 degrees, 45 degrees, 60 degrees, etc., and its orthogonal counterpart. Additionally, it may also be utilized to either transmit or received either right or left handed circularly polarized radio frequency signals.

Elements 44*a*, 44*b* of the two separate log-periodic antennas increase in length as the periphery of the antenna assembly is approached according to a log-periodic configuration. Element 50, a resistive film, is formed at the distal ends of the elements 44*b*. As described above, the size of the resistive film, length B and width A, is selected to increase the apparent length of elements 44*b*.

With particular reference to FIG. 3, the conformal log-periodic antenna assembly of the present invention is preferably configured such that the thickness thereof dimension A, which excludes the metal back 22, is such that longer wave lengths of radio frequency electromagnetic radiation are reflected from the metal backing 22 back to the etched antennas 12 in a manner which reinforces the intensity thereof. According to the preferred embodiment of the present invention, dimension A is approximately 0.5 inch.

According to the preferred embodiment of the present invention, the diameter of the conformal log-periodic antenna assembly, dimension B of FIG. 2, is approximately 3.125 inches. The absorber is preferably approximately 0.167 inch thick. The dielectric is preferably approximately 0.06 inch thick. The foam spacer is approximately 0.25 inch thick.

Figure 4:
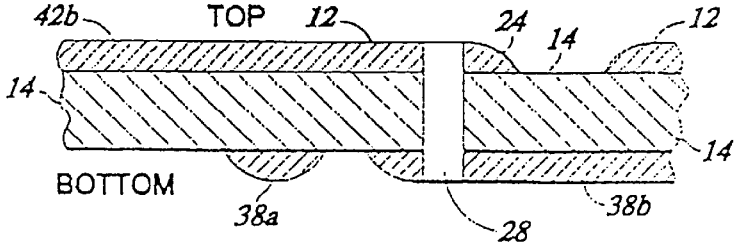
FIG. 4 is an enlarged side view, partially in section, showing the vias and bridge used to interconnect two of the diagonally opposed trunks of one of the two log-periodic antennas of the assembly of FIG. 1.

Referring now to FIG. 4, the electrical connection of one of the trunks, such as 42*b*, to the associated microstrip conductor 38*b*, is shown. The microstrip conductor is formed on the bottom of the printed wiring board 14 and extends from the conductor block 34*b* to approximately the center of the printed wiring board 14 where a V at 28 provides electrical connection to the trunk 42*b* on the top of the printed wiring board 14. Both of the microstrip's conductors 38*a*, 38*b* are attached to their associated trunks 42*a*, 42*b* in this fashion. However, those skilled in the art will appreciate that various other means for inner connecting the microstrip's conductors 38*a*, 38*b* and their associated trunks 42*a*, 42*b* are likewise suitable.

Figure 5:
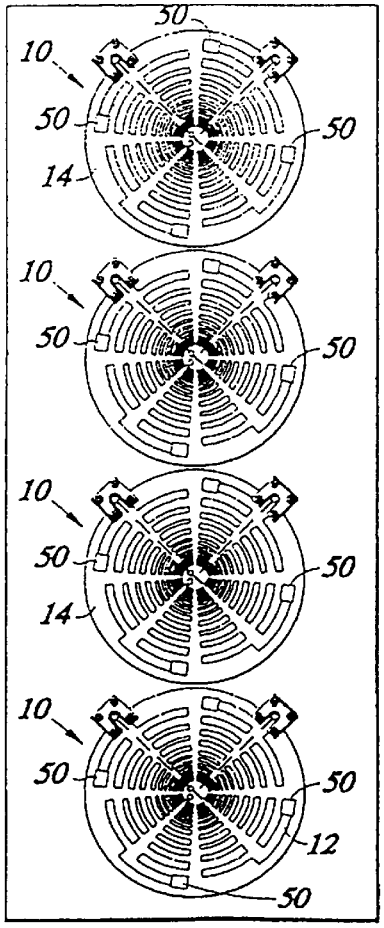
FIG. 5 is a front view of a linear array of four conformal log-periodic antenna assemblies of the present invention.

Referring now to FIG. 5, a linear array comprised of four separate log-periodic antenna assemblies of the present invention as shown. Such an array may be utilized so as to increase the gain of the antenna system, thereby facilitating the detection of the weaker radio signals.

Figure 6:
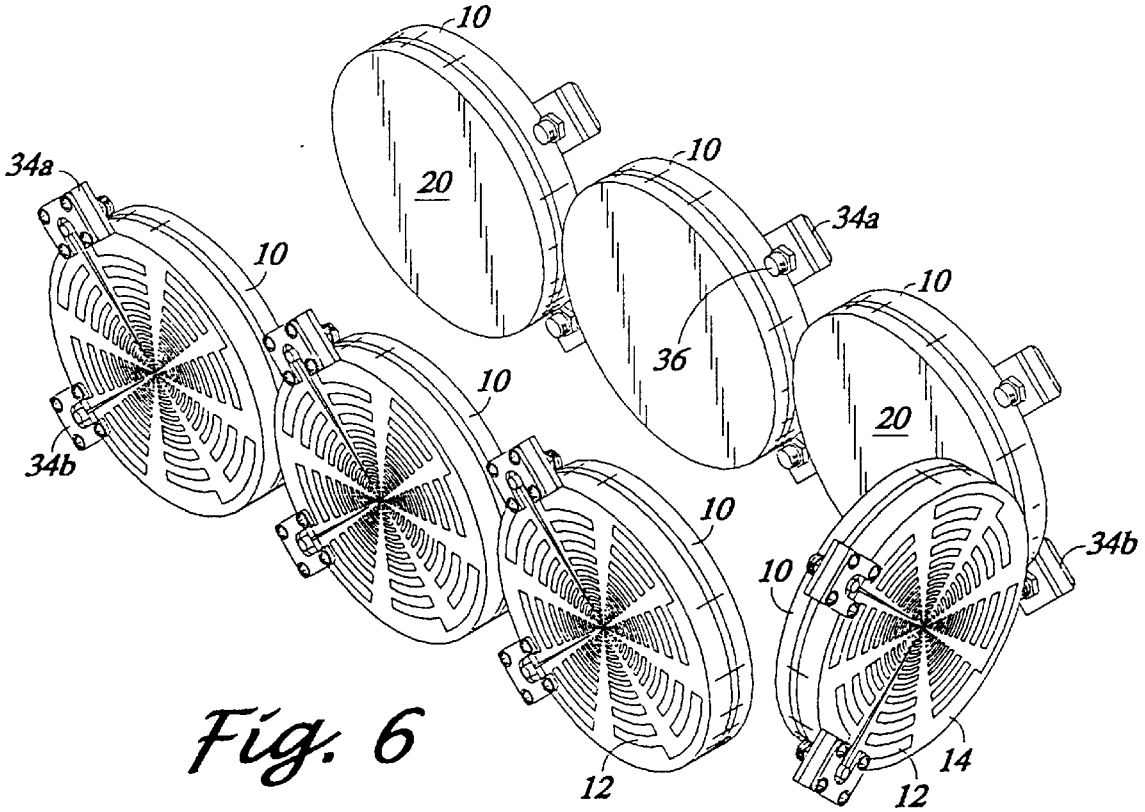
FIG. 6 is a generally U-shaped array of conformal log-periodic antenna assemblies of the present invention.

Referring now to FIG. 6, a generally U-shaped array of log-periodic antenna assemblies is shown. The log-periodic antenna assemblies of the present invention find particular applications in unmanned air vehicles. These antennas are configured so as to wrap generally around the sides and front of such an unmanned air vehicle, thereby providing a broad coverage area for the reception and transmission of broadband radio frequency signals.

Having described the structure of the conformal log-periodic antenna assembly of the present invention, it may be beneficial to describe the operation thereof. Consider a vertically polarized radio frequency signal having a wavelength corresponding approximately to four times the length of the longest antenna elements 44*b* attached to trunks 40*b* and 42*b*. The positive portion of such a radio frequency signal will induce current into the two longest antenna elements 44*b*. The induced current will be conducted to the feed lines via the two trunks 40*b* and 42*b*. The signal will be carried from trunk 42*b* to the center conductor 48 of the second conductor block 34*b* via micro strip conductor block 34*b* which attaches to trunk 42 as desired in detail above.

Since the two generally vertical longest antenna elements 44*b* are connected to their respective trunks 40*b* and 42*b* at opposite ends thereof, i.e., the longest antenna element 44*b* connected to trunk 42*b* is attached at the top thereof and the longest antenna element 44*b* connected to trunk 40*b* is attached at the bottom thereof, the polarity of the induced signals at the connector block 34*b* reinforce one another. Thus, the conformal log-periodic antenna assembly of the present invention operates according to well known principles to receive broadband radio signals.

The use of foam spacer 16, as well as generally flexible printed wiring board 14, flexible dielectric layer 18, and flexible absorber 20 facilitate conformance of the log periodic antenna of the present invention to a curved metal backing 22. Thus, the metal backing 22 may comprise the curved surface of an aircraft panel, for example. In this manner, the log-periodic antenna assembly of the present invention conforms generally to the shape of the fuselage and/or wings of an aircraft, so as to minimize aero dynamic drag thereon.

It is understood that the exemplary conformal log-periodic antenna assembly described herein and shown in the drawings represents only a presently preferred embodiment of the invention. Indeed, various modifications and additions may be made to such embodiment without departing from the spirit and scope of the invention. For example, the antenna assembly need not be generally circular, as described and shown. Rather, the overall shape of the antenna assembly may be any other shape, as desired. For example, the log-periodic antenna assembly may be hexagonal or octagonal. Further, those skilled in the art will appreciate that various other means for attaching the center portion of the micro strip conductor to the adjacent trunk are likewise suitable. For example, a wire connection may be utilized. Alternatively, a wire may be utilized in place of the micro strip conductor to provide a signal path from the connector block to the center portion a trunk.

Thus, these and other modifications and additions may be obvious to those skilled in the art and may be implemented to adapt the present invention for use in a variety of different applications.

What is claimed is:

1. A conformal log-periodic antenna assembly having a broadband frequency response, the antenna assembly comprising:

a) a printed wiring board having front and back sides;

b) a plurality of non-overlaping log-periodic antennas etched upon at least one side of the printed wiring board, each log-periodic antenna separated by a spacing extending generally radially from a common point, each log-periodic antenna comprising a plurality of antenna elements extending from a common trunk, the trunk of each log-periodic antenna extending generally radially from the common point;

c) a foam spacer having front and back sides disposed at the back side of the printed wiring board;

d) a dielectric layer having front and back sides disposed at the back of the foam spacer;

e) an absorber layer having front and back sides disposed at the back of the dielectric layer;

f) a metal backing disposed at the back side of the absorber layer for reflecting lower frequency electromagnetic radiation back to the antennas so as to enhance an intensity thereof;

g) wherein the dielectric layer enhances response across a broadband and the foam spacer positions the antennas a desired distance from the metal backing.

2. The conformal log-periodic antenna assembly as recited in claim 1 wherein the antenna elements comprise portions of generally concentric circles.

3. The conformal log-periodic antenna assembly as recited in claim 1 wherein each antenna comprises two diametrically opposed trunks, each diametrically opposed trunk having elements of substantially identical lengths extending generally perpendicularly therefrom in generally opposite directions with respect to each other diametrically opposed trunk.

4. The conformal log-periodic antenna assembly as recited in claim 1 wherein the foam spacer positions the antennas a distance from the metal backing which mitigates destructive interference from electromagnetic radiation reflected from the metal backing.

5. The conformal log-periodic antenna assembly as recited in claim 1 wherein the foam has a sufficient thickness to position the antennas approximately 0.5 inch from the metal backing.

6. The conformal log-periodic antenna assembly as recited in claim 1 wherein the plurality of log-periodic antennas comprise two log-periodic antennas disposed generally orthogonal to one another, so as to facilitate reception and transmission of a plurality of polarizations of plane polarized electromagnetic radiation and circularly polarized electromagnetic radiation.

7. The conformal log-periodic antenna assembly as recited in claim 1 wherein the plurality of log-periodic antennas comprise two log-periodic antennas disposed generally orthogonal to one another, each of the two antennas comprising two diametrically opposed trunks.

8. The conformal log-periodic antenna assembly as recited in claim 1 further comprising a resistive film formed at a distal end of at least one of the elements of at least one of the antennas so as to enhance a response of the element(s).

9. The conformal log-periodic antenna assembly as recited in claim 1 further comprising a resistive film formed at a distal end of a plurality of the elements so as to increase an apparent length thereof and thus enhance a response of the elements to lower frequencies.

10. The conformal log-periodic antenna assembly as recited in claim 1 wherein the antennas are etched upon the front side of the printed wiring board.

11. The conformal log-periodic antenna assembly as recited in claim 1 wherein the foam spacer is sufficiently thick so as to allow the antenna assembly to substantially conform to a curved metal backing.

12. The conformal log-periodic antenna assembly as recited in claim 1 wherein the printed wiring board is sufficiently thin so as to allow the antenna assembly to substantially conform to a curved metal backing.

13. The conformal log-periodic antenna assembly as recited in claim 1 wherein the printed wiring board is sufficiently flexible so as to allow the antenna assembly to substantially conform to a curved backing.

14. The conformal log-periodic antenna assembly as recited in claim 1 wherein the printed wiring board, foam spacer, dielectric layer, and absorber layer are configured so as to substantially conform to a curved backing.

15. The conformal log-periodic antenna assembly as recited in claim 1 wherein the metal backing is defined by a pre-existing structure.

16. The conformal log-periodic antenna assembly as recited in claim 1 wherein the metal backing is defined by a portion of an aircraft.

17. The conformal log-periodic antenna assembly as recited in claim 1 wherein the metal backing is defined by an unmanned air vehicle.

18. The conformal log-periodic antenna assembly as recited in claim 1 wherein the metal backing supports the printed wiring board.

19. The conformal log-periodic antenna assembly as recited in claim 1 wherein the dielectric layer comprises one of epoxy and fiberglass.

20. The conformal log-periodic antenna assembly as recited in claim 1 wherein the absorber comprises an electrically lossy material for absorbing electromagnetic radiation by inducing currents therefrom and by converting the electric currents into thermal energy.

21. The conformal log-periodic antenna assembly as recited in claim 1 wherein the absorber comprises Megram.

22. The conformal log-periodic antenna assembly as recited in claim 1 wherein the absorber is approximately 0.167 inch thick.

23. The conformal log-periodic antenna assembly as recited in claim 1 wherein the dielectric is approximately 0.06 inch thick.

24. The conformal log-periodic antenna assembly as recited in claim 1 wherein the foam spacer is approximately 0.25 inch thick.

25. A conformal log-periodic antenna array, the array comprising a plurality of broadband log-periodic antenna assemblies, each antenna assembly comprising:

a) a printed wiring board having front and back sides;

b) a plurality of non-overlappying log-periodic antennas etched upon at least one side of the printed wiring board, each log-periodic antenna separated by a spacing extending generally radially from a common point, each log-periodic antenna comprising a plurality of antenna elements extending from a common trunk, the trunk of each log-periodic antenna extending generally radially from the common point;

c) a foam spacer having front and back sides disposed at the back side of the printed wiring board;

d) a dielectric layer having front and back sides disposed at the back of the foam spacer;

e) an absorber layer having front and back sides disposed at the back of the dielectric layer;

f) a metal backing disposed at the back side of the absorber layer for reflecting lower frequency electromagnetic radiation back to the antennas so as to enhance an intensity thereof;

g) wherein the dielectric layer enhances response across a broadband and the foam spacer positions the antennas a desired distance from the metal backing.

26. A conformal log-periodic antenna array, the array comprising a plurality of broadband log-periodic antenna assemblies, each antenna assembly comprising:

a) a printed wiring board having front and back sides;

b) a plurality of log-periodic antennas etched upon at least one side of the printed wiring board, each log-periodic antenna comprising a plurality of antenna elements extending from a common trunk, the trunk of each log-periodic antenna extending generally radially from a common point;

c) a resistive film formed at a distal end of at least one of the plurality of antenna elements so as to enhance a response of the elements;

d) a foam spacer having front and back sides disposed at the back side of the printed wiring board;

e) a dielectric layer having front and back sides disposed at the back of the foam spacer;

f) an absorber layer having front and back sides disposed at the back of the dielectric layer;

g) a metal backing disposed at the back side of the absorber layer for reflecting lower frequency electromagnetic radiation back to the antennas so as to enhance an intensity thereof;

h) wherein the dielectric layer enhances response across a broadband and the foam spacer positions the antennas a desired distance from the metal backing.

27. A conformal log-periodic antenna array, the array comprising a plurality of broadband log-periodic antenna assemblies, each antenna assembly comprising:

a) a printed wiring board having front and back sides;

b) a plurality of log-periodic antenna etched upon at least one side of the printed wiring board, each log-periodic antenna comprising a plurality of antenna elements extending from a common trunk, the trunk of each log-periodic antenna extending generally radially from a common point;

c) a resistive film formed at a distal end of the plurality of antenna elements so as to increase an apparent length thereof and thus enhance a response of the elements to lower frequencies;

d) a foam spacer having front and back sides disposed at the back side of the printed wiring board;

e) a dielectric layer having front and back sides disposed at the back of the foam spacer;

f) an absorber layer having front and back sides disposed at the back of the dielectric layer;

g) a metal backing disposed at the back side of the absorber layer for reflecting lower frequency electromagnetic radiation back to the antennas so as to enhance an intensity thereof;

h) wherein the dielectric layer enhances response across a broadband and the foam spacer positions the antennas a desired distance from the metal backing.

28. A conformal log-periodic antenna assembly having a broadband frequency response, the antenna assembly comprising;

a) a printed wiring board having front and back sides;

b) a plurality of non-overlapping log-periodic antennas etched upon at least one side of the printed wiring board, each log-periodic antenna separated by a spacing extending generally radially from a common point, each log-periodic antenna comprising a plurality of antenna elements extending from a common trunk, the trunk of each log-periodic antenna extending generally radially from the common point;

c) a resistive film formed at a distal end of at least one of the plurality of antenna elements so as to enhance a response of the elements;

d) a foam spacer having front and back sides disposed at the back side of the printed wiring board;

e) a dielectric layer having front and back sides disposed at the back of the foam spacer;

f) an absorber layer having front and back sides disposed at the back of the dielectric layer;

g) a metal backing disposed at the back side of the absorber layer for reflecting lower frequency electromagnetic radiation back to the antennas so as to enhance an intensity thereof;

h) wherein the dielectric layer enhances response across a broadband and the foam spacer positions the antennas a desired distance from the metal backing.

29. A conformal log-periodic antenna assembly having a broadband frequency response, the antenna assembly comprising:

a) a printed wiring board having front and back sides;

b) a plurality of non-overlapping log-periodic antennas etched upon at least one side of the printed wiring board, each log-periodic antenna separated by a spacing extending generally radially from a common point, each log-periodic antenna comprising a plurality of antenna elements extending from a common trunk, the trunk of each log-periodic antenna extending generally radially from the common point;

c) a resistive film formed at a distal end of the plurality of antenna elements so as to increase an apparent length thereof and thus enhance a response of the elements to lower frequencies;

d) a foam spacer having front and back sides disposed at the back side of the printed wiring board;

e) a dielectric layer having front and back sides disposed at the back of the foam spacer;

f) an absorber layer having front and back sides disposed at the back of the dielectric layer;

g) a metal backing disposed at the back side of the absorber layer for reflecting lower frequency electromagnetic radiation back to the antennas so as to enhance an intensity thereof;

g) wherein the dielectric layer enhances response across a broadband and the foam spacer positions the antennas a desired distance from the metal backing.

* * * * *